United States Patent [19]

Brennan

[11] 4,338,847

[45] Jul. 13, 1982

[54] ELECTROMAGNETIC DEVICES FOR ACTUATING PIANO KEYS

[76] Inventor: John F. Brennan, John F. Kennedy La., Lebanon, Ky. 40033

[21] Appl. No.: 206,871

[22] Filed: Nov. 14, 1980

[51] Int. Cl.[3] ..... G10F 1/02

[52] U.S. Cl. ..... 84/20; 84/107

[58] Field of Search ..... 84/12, 19–22, 84/105, 107, 111, 115

[56] References Cited

U.S. PATENT DOCUMENTS

| | | | |
|---|---|---|---|
| 488,482 | 12/1892 | Pain | 84/19 |
| 784,457 | 3/1905 | Weber | 84/20 |
| 784,508 | 3/1905 | Weber | 84/20 |
| 1,003,201 | 9/1911 | Phillips | 84/22 |

*Primary Examiner*—Lawrence R. Franklin
*Attorney, Agent, or Firm*—Gary, Juettner & Pyle

[57] ABSTRACT

Electromagnetic devices for actuating piano keys are responsive to music in an encoded format, for example as might be contained on a magnetic tape or phonograph record, to selectively actuate the keys with controlled forces and for selected durations. A separate device is provided for each key, and the devices are operable to authentically reproduce musical renditions. In one embodiment, a single electromagnet is associated with each key rearwardly of the piano headboard, and an energizing signal applied thereto is controlled to determine the intensity and duration of note played. In another embodiment, a plurality of electromagnets are associated with each key rearwardly of the headboard, and are selectively energized to determine the intensity and duration of note played. It is also contemplated to mount various arrangements of electromagnets within a housing, and to place the housing across the front of the keyboard to actuate the keys.

12 Claims, 8 Drawing Figures

ELECTROMAGNETIC DEVICES FOR ACTUATING PIANO KEYS

BACKGROUND OF THE INVENTION

The present invention relates to electromagnetic devices for automatically actuating piano keys.

Various types of apparatus are known in the art for automatically actuating piano keys. One such apparatus, for example, is the old roll-type player piano. This type of piano, however, has many disadvantages, among which are the large space required for storage of paper rolls, the high cost of the rolls, the inconvenience of loading and unloading the rolls in the piano, the high cost of repairing the piano and the complexity of the piano, which includes bellows or vacuum pumps, and the inability to provide variations in the intensity and duration of notes played.

More recently, to overcome most of the disadvantages associated with using paper rolls to control operation of a player piano, magnetic recording tapes have been used to record and then play back musical notes on a piano. Some advantages to the use of tapes are that the piano key actuating mechanisms may be made to be less complex and expensive to build and maintain. Also, there is no problem of tearing the recording media, the tapes are capable of storing a large quantity of recorded data in a relatively small space, and they are much less costly and easier to produce than perforated rolls. Furthermore, if a casette type tape player is used, it is never necessary to touch the actual tape, which is simply plugged in or out.

Inasmuch as magnetic tapes are capable of storing high density recorded data, it is possible with tapes to readily and conveniently store data representative both of the intensity of notes to be played, or of the force used to actuate piano keys, and of the duration for which notes are to be held. To take advantage of and utilize the relatively great data density of a tape, recent developments also contemplate use of electromagnetic actuation for piano keys, inasmuch as electromagnets are readily responsive to suitably processed signals from a magnetic tape and generally provide a significant degree of control over the intensity and duration of notes played at the least expense. However, even such simple devices as electromagnets have not heretofore found favor in the piano industry as a means for actuating piano keys, because substantial modifications in a piano structure have had to be made to incorporate electromagnetic actuating systems therein, and complex and expensive equipment has been necessary to cause the systems to apply forces to the keys which are similar to those which would otherwise be applied by hand. In addition, conventional electromagnetic piano key actuating systems usually produce clicking sounds when a key is struck or played, and have not been well suited to rapid key reaction times or stacatto playing. For representative examples of electromagnetically actuated player pianos, reference is made to U.S. Pat. Nos. 3,141,368, 3,149,528, 3,160,052, 3,195,389, 3,647,929, 3,789,719, 3,895,554, 3,905,267 and 4,132,141.

OBJECTS OF THE INVENTION

An object of the present invention is to provide an electromagnetic apparatus of simple and inexpensive design for actuating a piano key.

Another object of the invention is to provide such an apparatus which can actuate a piano key with a force analagous to that which would be applied if the key were manually played.

A further object of the invention is to provide such an apparatus which can control not only the intensity of notes played, but also the duration of the notes.

Yet another object of the invention is to provide such an apparatus which may be easily installed on a piano either at the factory or in the home of a user, and which does not interfere with ordinary playing or manual use of the piano.

A still further object of the invention is to provide such an apparatus in which there are no clicking noises associates with actuation of a key, and which is capable of very rapid key operation for stacatto playing.

SUMMARY OF THE INVENTION

In accordance with the present invention, in combination with a piano having a piano key mounted for pivotal movement about a fulcrum, the piano key having a rearward end to a rearward side of the fulcrum which moves upwardly upon playing a note, there is provided a piano key actuating system comprising a plug of ferromagnetic material mounted on an upper surface of the rearward end of the piano key. Also included is an electromagnet having a winding across which an energizing signal may be applied, and means for mounting the electromagnet to present a pole face thereof toward but spaced from the plug. Upon application of an energizing signal across the windings, the electromagnet generates a magnetic field at its pole face to attract the plug and to raise the rearward end of the key to strike a note on the piano. The means for mounting places the pole face at a distance from the plug which is greater than the maximum upward movement of the plug upon energization of the electromagnet, so that no contact occurs between the pole face and the plug and no extraneous noises are generated upon striking a note.

In another embodiment of the foregoing type, a piano key actuating system comprises a plurality of electromagnets and a plurality of associated plugs of ferromagnetic material mounted on and along the upper surface of the rearward end of the piano key, such that upon application of an energizing signal to one or more of the electromagnet windings the energized electromagnets generate magnetic fields at their pole faces to attract their associated plugs and raise the rearward end of the key to strike a note. A space is always maintained between the electromagnet pole faces and the plugs, so that no contact occurs between the same and no extraneous noises are generated upon striking a note. In the first described embodiment, the intensity of note played is determined by controlling the strength of energizing signal applied to the electromagnet, whereas in the instant embodiment the intensity may be controlled by energizing a selected one or more of the electromagnets and/or by controlling the strength of the signals applied thereto.

In accordance with a preferred embodiment of the invention, there is provided in combination with a piano having a piano key mounted for pivotal movement about a fulcrum, the key having a forward end to a forward side of the fulcrum which is depressed or moved downwardly to play a note, a piano key actuating system comprising a first electromagnet having a winding across which an energizing signal may be applied. Also included is a second electromagnet having a winding across which an energizing signal may be applied, and means for movably mounting the first electromagnet above an upper surface of the forward end of the key for movement toward and away from the upper surface. Means extend between the first electromagnet and the upper surface of the key for depressing the forward end of the key upon downward movement of the first electromagnet, means fixably mounts the second electromagnet above the first, such that the same present opposed and spaced pole faces to each other, and means interconnects the first and second electromagnet windings, so that upon application of an energizing signal like magnetic poles are developed at the opposed pole faces. Thus, upon application of an energizing signal, the first electromagnet is repelled away from the second and toward the upper surface of the key to depress the key and strike a note on the piano. It is contemplated that the first and second electromagnets be mounted and electrically connected such that application of an energizing signal causes the first electromagnet to move toward the second to strike a note, and that pluralities of pairs of first and second electromagnets may be combined to form the piano key actuating system.

The foregoing and other objects, advantages and features of the invention will become apparent upon a consideration of the following detailed description, when taken in conjunction with the accompanying drawings.

DETAILED DESCRIPTION

The present invention provides various embodiments of electromagnetic apparatus for actuating piano keys in a manner such that an entire gamut of a piano repertoire may be played just as though the same were being played manually. The apparatus is inexpensive and reliable in construction, and may be readily and conveniently installed on a piano either at the factory or in the home of an owner. The apparatus does not interference with ordinary or manual use of the piano, yet is responsive to data contained on a magnetic tape or other suitable recording media to exert on the piano keys forces which sound notes with precise volumes from pppp to ffff and for desired durations, whereby the apparatus reproduces renditions exactly as though the same were played manually by a pianist. The apparatus is capable of sustaining notes without pedal action and of rapid or stacatto playing, and in its use there are no annoying clicking or other noises associated with actuation of the keys.

Figure 1:
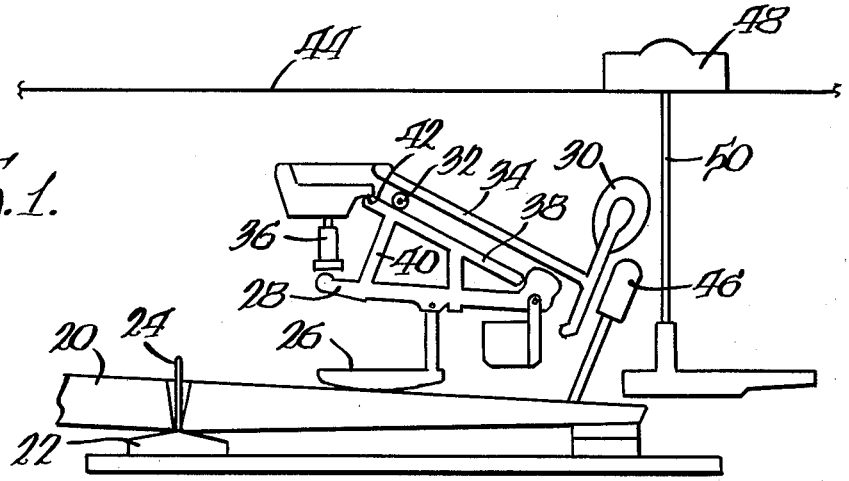
FIG. 1 is a side elevation view of one type of modern piano action for a single key of a piano.

Referring to the drawings, FIG. 1 illustrates by way of example, a movement for a modern grand piano. When a forward end of a piano key 20 is depressed, its rearward end rises about a fulcrum 22 and a pivot stem 24 to lift a wippen 26. The wippen raises a pivoted jack 28 that pushes a hammer 30 upward by means of a small roller 32 attached to the underside of a shank 34 of the hammer, and the hammer flies free when the back of the jack touches an adjustable regulating button 36. At the same time, the upper end of a repetition lever 38, through which an upright arm 40 of the jack passes, rises until it is stopped by a drop screw 42. When the hammer rebounds from a piano string 44, the roller falls back until it is stopped by the repetition lever, enabling the tip of the jack to return to position beneath the roller, even if the key is still partially depressed. The jack is then ready to raise the hammer again should the player restrike the key before it returns to rest position. In the meantime, the hammer is prevented from bouncing back up toward the strings by a padded damper check 46, and a damper 48 is raised above the string by a lever 50 lifted by an extreme end of the key. Similar actions are provided for each of the remaining eighty-seven keys of the piano.

Figure 2:
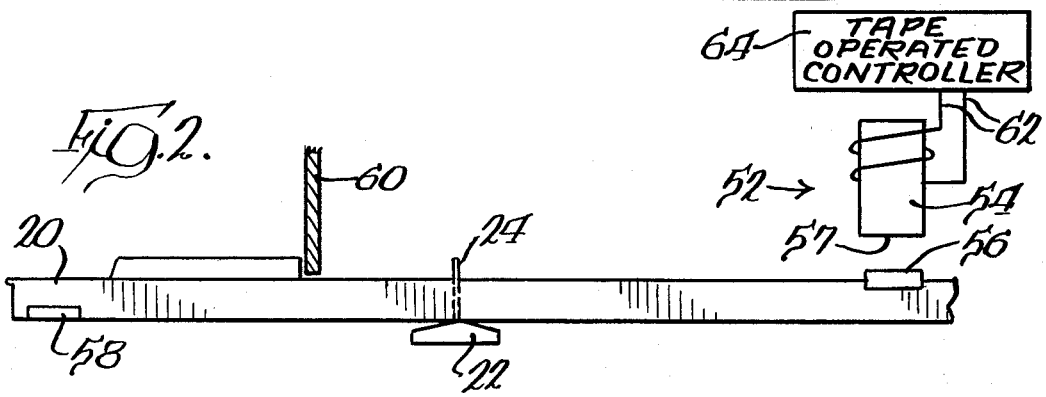
FIG. 2 is a side elevation view of an electromagnetic piano key actuating apparatus in accordance with one embodiment of the invention.

Turning to FIG. 2, there is diagrammatically shown in accordance with one embodiment of the invention an electromagnetic apparatus, indicated generally at 52, for actuating the piano key 20 just as though the same had been manually played. To this end, and it being understood that a similar apparatus is associated with each of the keys, an electromagnet 54 is suitably mounted rearwardly of the key pivot stem 24 and forwardly of the piano action above a plug 56 of iron or other ferromagnetic material secured to or in the upper surface of the key 20 between the stem and the action. Upon energization of the electromagnet, a magnetic pole is generated at a lower surface or pole face 57 thereof and the plug, and therefore the rearward end of the piano key, is attracted upwardly to operate the action and play a note. The spacing between the lower pole face of the electromagnet and the plug is greater than the upward movement of the key thereat, so that there is never any physical contact between the plug and the pole face and no clicking noises occur incident to a note being played. To facilitate manual or normal playing of the piano, a counterweight 58 may be attached to the underside of the key at the forward end thereof to counteract the weight of the plug 56. Thus, the piano key as a normal "touch" and the piano may in all respects be played manually without any detrimental effect from the electromagnetic key actuating apparatus.

To exert a selected force on the plug 56, thereby to actuate the key 20 with a variable and desired force to precisely operate the same over a range from pppp to ffff, exactly as though a pianist had played the key, the strength of the energizing signal applied to the electromagnet 54 is precisely controlled so that a magnetic field is generated of a strength which exerts the selected force on the plug. At the same time, to control the duration of note played, the time for which the energizing signal is applied to the electromagnet is controlled, such that whenever and for as long as a signal is applied the electromagnet is energized to hold the plug in its upward position and to continue to play the note without damping. For the purpose, windings 62 of the electromagnet are connected with a tape operated controller 64, which is responsive to information recorded on a magnetic tape to apply across the windings a signal having a magnitude and duration which energizes the electromagnet in a manner to precisely control the intensity and duration of note played. The tape operated controller may be of any suitable conventional type, such for example as disclosed in U.S. Pat. Nos. 3,195,389, 3,604,299, 3,647,929, 3,683,096, 3,789,719, 3,895,554, 3,905,267 and 4,132,141, the teachings of which are specifically incorporated herein by reference. On the other hand, and if desired, the necessary information may be contained on any other suitable recording media.

Figure 3:
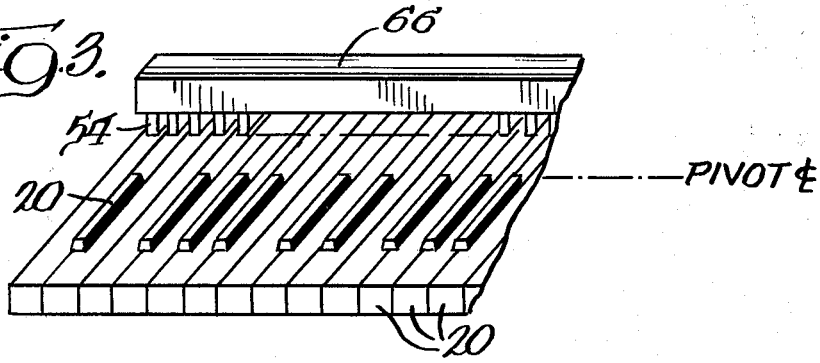
FIG. 3 is a partial perspective view of a piano keyboard, showing the relationship of a plurality of electromagnetic piano key actuating apparatuses of FIG. 2 with respect to the piano keyboard.

FIG. 3 illustrates the embodiment of invention of FIG. 2 implemented in a piano. In particular, after a plug 56 and a counterweight 58 have been mounted on each of the eighty-eight keys of the piano, a plurality of electromagnets 54, mounted within an elongate housing 66, are positioned above their associated plugs by mounting opposite ends of the housing on opposite sides of the piano cabinet. The windings of each electromagnet are connected with the controller 64 which then, in accordance with the recorded information, selectively energizes the electromagnets with signals of controlled strengths and durations, so that key responses and dynamic variations are provided to reproduce a piano repertoire. By merely maintaining an energizing signal to one or more selected electromagnets, notes may be sustained without pedal action, and the reaction time of the electromagnets is sufficiently fast that stacatto playing is possible. The apparatus may be installed on the piano at the factory, although in view of the simplicity of its structure and the ease with which an elongate housing 66 may be mounted within a piano cabinet, the same may just as readily be installed on a piano in the home of a user.

Figure 4:
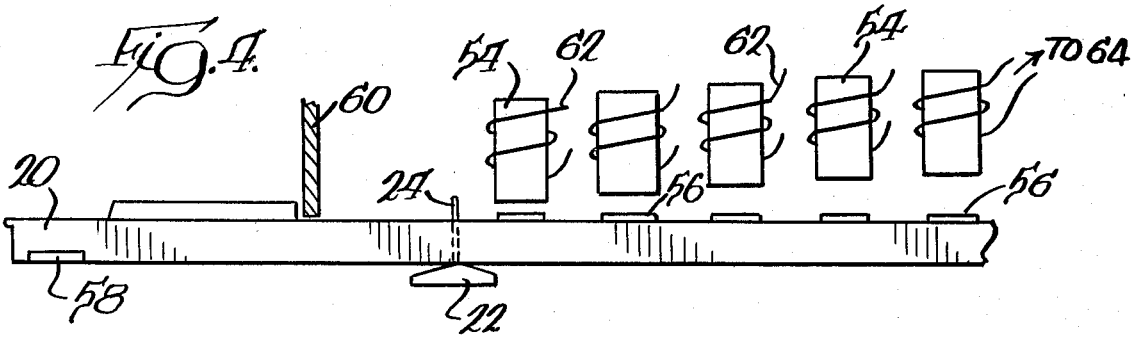
FIG. 4 is a side elevation view of an electromagnetic piano key actuating apparatus in accordance with a second embodiment of the invention.

FIG. 4 shows another embodiment of electromagnetic piano key actuating apparatus in accordance with the teachings of the invention, which also is particularly adapted for controlling the intensity and duration of notes played. In this case, instead of a single electromagnet 54 and plug 56 being associated with each piano key 20, a plurality (five as shown) of electromagnets and plugs are provided for each key. The windings 62 of each electromagnet are connected with the tape operated controller 64, and to control the intensity of note played a selected one or more of the electromagnets is energized. Obviously, the further away from the fulcrum 22 an electromagnet 54 is located, the greater the torque it is capable of exerting on the piano key, so that significant numbers of variations in intensities of notes played may be obtained by selective energization of one or more of the electromagnets, combined with control over the strengths of energizing signals applied to the electromagnets. At the same time, the duration of note played may readily be determined by controlling the time for which an energizing signal is applied to the electromagnets, or to only one of the electromagnets for that matter. If desired, and to decrease the total power consumption and heating of the system, once a note has been struck with a desired intensity, the duration for which it is played may be controlled by applying a reduced value signal to only one of the electromagnets, it only being necessary that the signal be of sufficient strength to maintain the rearward end of the key elevated.

Figure 5:
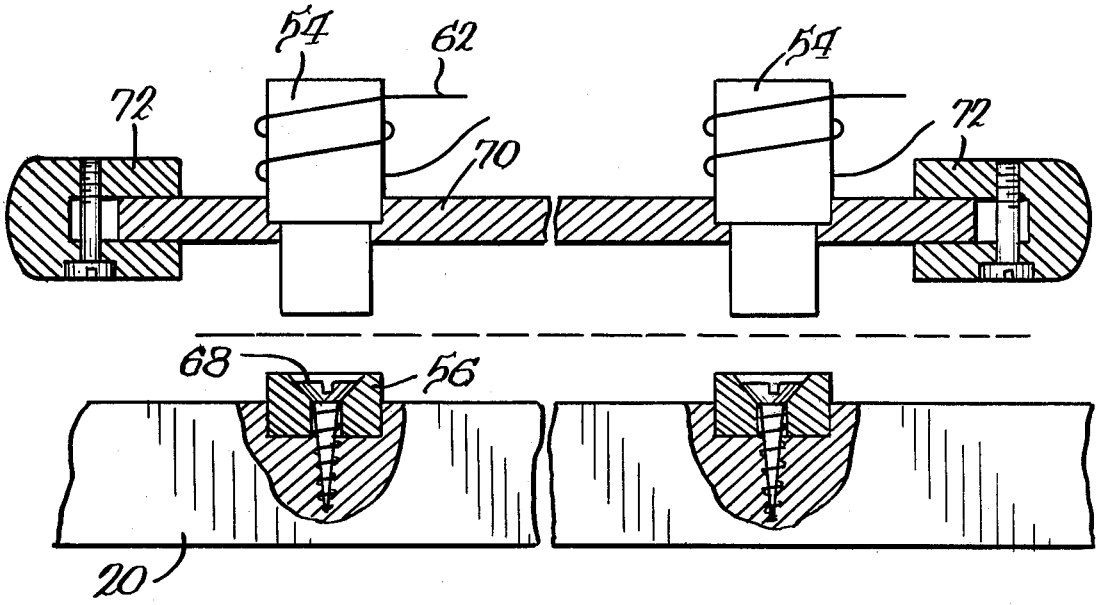
FIG. 5 is a side elevation view, partly in cross section, illustrating one arrangement for mounting the apparatus of FIG. 4.

One suitable arrangement for mounting the electromagnets 54 and plugs 56 illustrated in FIG. 4 is shown in FIG. 5. To this end, the plugs may be adhesively affixed to each piano key 20 or, as shown, be secured thereto by means of fasteners 68, which preferably are of iron or another ferromagnetic material. To mount the electromagnets above the plugs, the same are advantageously positioned in a support plate 70, which is supported at its side edges within a pair of elongate support bars 72. The support bars extend along the keys 20 and between opposite sides of the piano cabinet, or between the bass and treble of the piano, and are fastened to the piano cabinet by any suitable means to maintain the electromagnets over their associated keys and plugs. The electromagnets for each individual key may be mounted in a separate support plate 70, or all of the electromagnets for all of the eighty-eight keys of the piano may be mounted in a unitary support plate.

Figure 6:
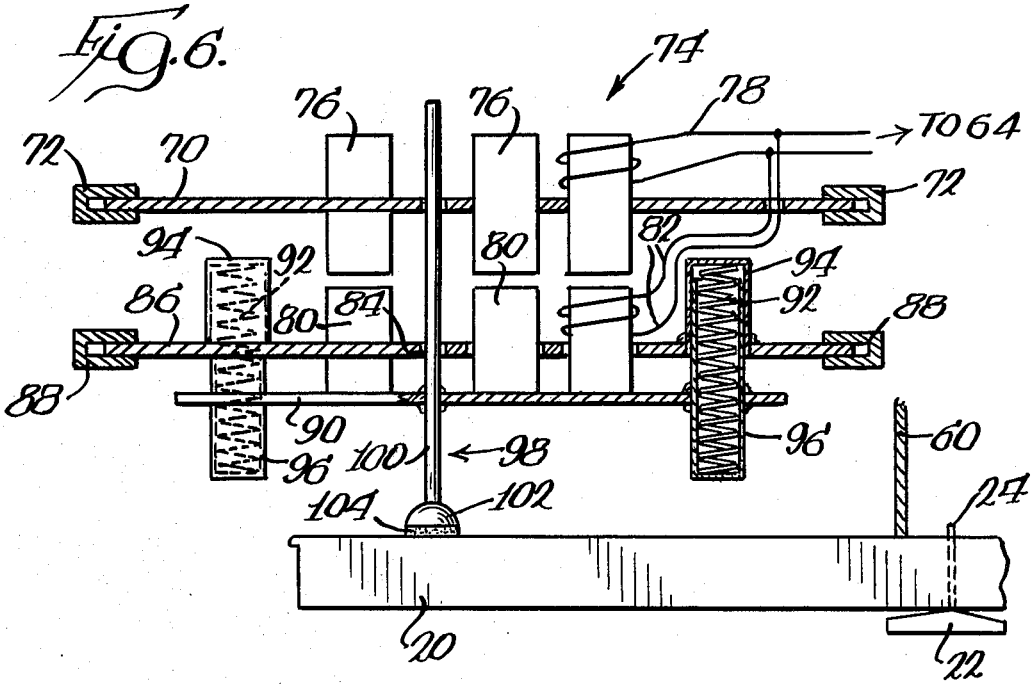
FIG. 6 is a side elevation view, partly in cross section, showing an electromagnetic piano key actuating apparatus in accordance with a third embodiment of the invention.

There is shown in FIG. 6 and indicated generally at 74 yet another embodiment of electromagnetic piano key actuating system in accordance with the teachings of the invention. This particular embodiment actuates or depresses the forward end of a piano key forwardly of the fulcrum 22 and piano headboard 60 to play a note, and includes a plurality of upper electromagnets 76 mounted on a support plate 70 above and along the upper surface of the piano key. The electromagnets are fixedly mounted in the plate, and opposite ends of the plate are received in support bars 72 which extend laterally of the piano keyboard and are suitably supported at opposite bass and treble sides of the piano cabinet.

Beneath and in alignment with the upper electromagnets 76 are a plurality of lower electromagnets 80, which are equal in number to and are each associated with an individual one of the electromagnets 76. Each electromagnet 80 has a winding 82 connected both with the winding 78 of its associated electromagnet 76 and with the tape operated controller 64, and the windings of associated electromagnets 76 and 80 are connected in opposition, so that upon an energizing signal being applied thereto the opposing pole faces of the electromagnets, i.e., the lower pole face of the electromagnet 76 and the upper pole face of the electromagnet 80, develop like magnetic poles, whereby the electromagnets are repelled apart.

To actuate the piano key 20 upon energization of the electromagnets, the electromagnets 80 are received for sliding movement within passages 84 in a support plate 86 mounted at opposite ends within a pair of support bars 88, which support bars extend laterally of the piano keyboard between opposite bass and treble sides of the piano. Lower ends of the electromagnets 80 are fastened to a support plate 90, which in turn is movably mounted on the plate 86 by means of springs 92, each of which is fastened at an upper end within an associated upper sleeve guide 94 and at a lower end within an associated lower sleeve guide 96. The result is that the movable plate 90 is ordinarily urged upwardly toward the plate 86, but may be moved downwardly toward the piano key 20 against the springs 92 upon energization of one or more associates pairs of electromagnets 76 and 80. To depress the piano key a plunger, indicated generally at 98, has a stem 100 affixed in the plate 90 and extending through guide passages in the plates 70 and 86. A lower end of the stem has a foot 102, and the lower surface of the foot advantageously is covered with a pad 104 of resilient material for resting against the upper surface of the key.

It may now be appreciated how the actuating device 74 operates to depress the key 20 with a precise force and for a desired duration to sound a note, it being understood that similar actuating devices 74 are associated with each of the remaining keys of the piano. Specifically, upon energization of at least one associated pair of electromagnets 76 and 80, like magnetic polarities develop at their opposed pole faces. This repels the lower electromagnet and the support plate 90 downwardly away from the upper electromagnet and toward the key, thereby moving the plunger 98 downwardly to depress the key and play a note. The arrangement is such that a space is at all times maintained between the opposing pole faces of the electromagnets and the felt pad 104 is advantageously continuously in contact with the piano key, whereby no mechanical or clicking noises occur incident to playing a note. Obviously, and as for the embodiment of invention shown in FIG. 4, the intensity of note played may be determined by the number of pairs of electromagnets 76 and 80 energized, as well as by the strengths of the energizing signals, and the duration of note played may be controlled by the time for which the electromagnets are energized. To minimize power consumption and heating, once a note has been struck it may be maintained, or its duration controlled, simply by energizing a single associated pair of electromagnets 76 and 80, and if desired by energizing the single pair with a reduced power input which need only be sufficient to maintain the damper out of contact with the piano string.

Figure 7:
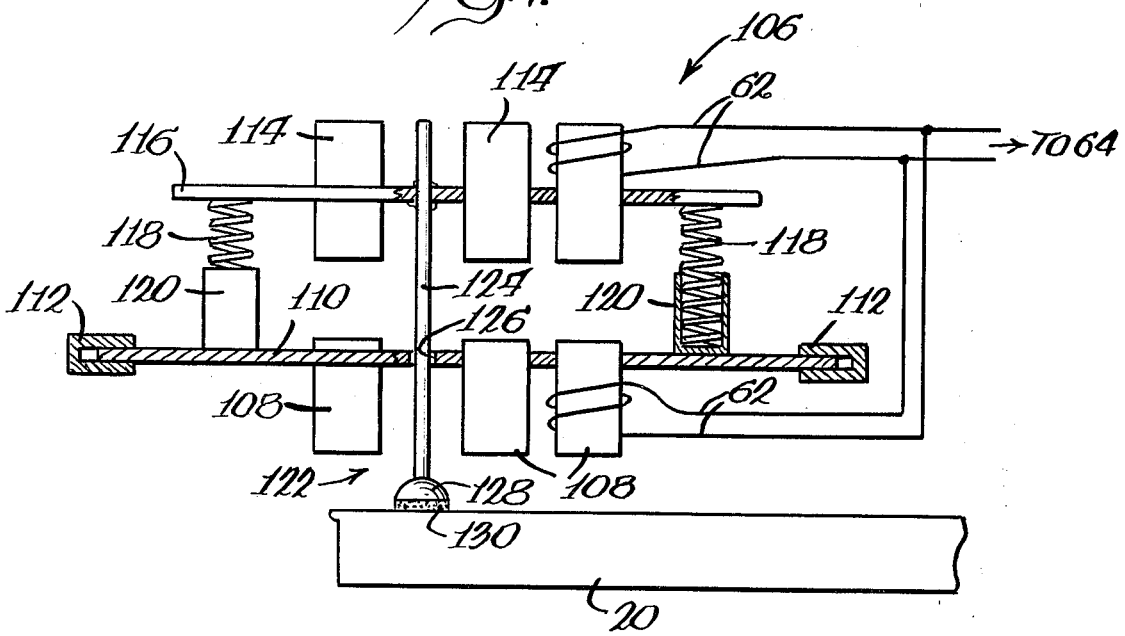
FIG. 7 is a side elevation view, partly in cross section, illustrating an electromagnetic piano key actuating apparatus in accordance with a fourth embodiment of the invention.

FIG. 7 illustrates a further embodiment of the invention which is generally similar to that in FIG. 6, except that the upper electromagnets are movable toward the lower electromagnets to actuate the piano key 20. More particularly, the electromagnetic piano key actuating device in FIG. 7 is indicated generally at 106 and includes a plurality of lower electromagnets 108 securely mounted in a plate 110. The plate is fastened at its opposite ends within a pair of support bars 112, and the support bars extend laterally of the piano keyboard and are suitable secured at opposite ends to opposite sides of the piano cabinet. Each electromagnet 108 has a winding 62 which is connected with the tape operated controller 64, and the electromagnets are positioned beneath associated ones of upper electromagnets 114. The upper electromagnets are secured within an upper support plate 116, and each includes a winding 62 connected with the winding of its associated lower electromagnet. The arrangement is such that upon energization of an associated pair of electromagnets 108 and 114, opposing pole faces thereof develop opposite magnetic polarities, whereby the electromagnets are attracted toward each other.

The plate 116 is mounted for movement toward and away from the plate 110 by means of a pair of springs 118 connected at their upper ends with the plate 116 at their lower ends within sleeve guides 120 mounted on the plate 110. A plunger, indicated generally at 122, has a stem 124 which is affixed within the plate 116 and extends through a guide passage 126 in the plate 110, and a foot 128 at a lower end of the stem carries a pad of flexible and preferably felt-like material 130 on its lower surface, which rests on the upper surface of the piano key.

It being understood that a like device 106 is associated with each and every one of the remaining keys of the piano, to strike a note one or more of the associated pairs of electromagnets 108 and 114 are energized to cause the upper electromagnets 114 to be attracted downwardly toward the lower electromagnets 108. This causes the plate 116 to move toward the plate 110, which moves the plunger 122 downwardly to actuate the key and strike a note. The number of pairs of electromagnets which are actuated determines the intensity of note struck, although it is understood that, as for FIG. 6, the intensity may additionally be controlled by the strengths of the energizing signals applied to the pairs of electromagnets. At the same time, the duration of notes struck may be controlled by the time for which the electromagnets are energized, and to conserve power and minimize heating, once a note has been struck it may be held by energizing only a single pair of electromagnets, at a reduced power level if desired.

Figure 8:
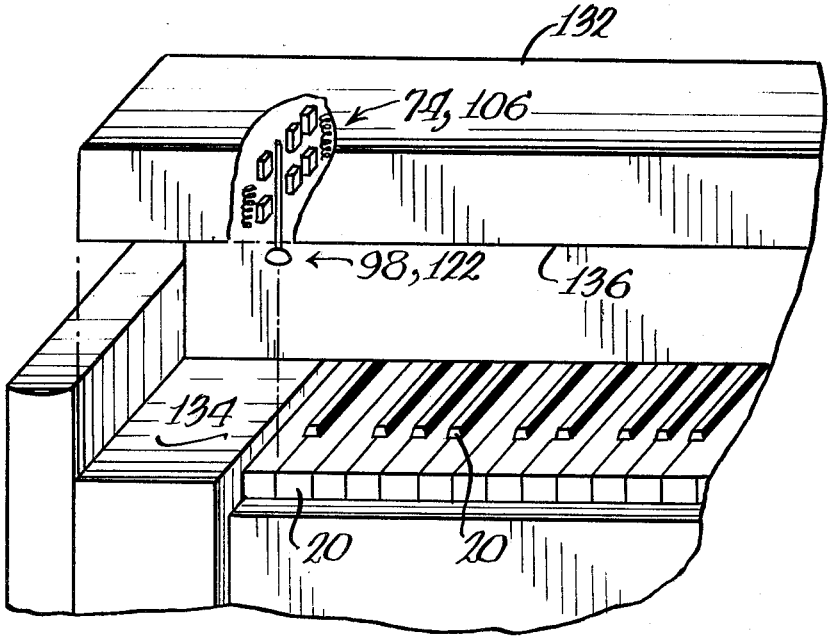
FIG. 8 is a partial perspective view of a piano cabinet and its keyboard, illustrating one arrangement for mounting an electromagnetic piano key actuating assembly of the type shown in FIG. 6 or 7 on a piano to actuate the keys thereof.

FIG. 8 illustrates one possible arrangement for conveniently implementing the embodiments of invention shown in FIGS. 6 and 7 in a piano. To this end, eighty-eight of the electromagnetic piano key actuating devices 74 or 106 may be assembled within a housing or cabinet 132, which is adapted to be placed on side end shelves 134 of the piano cabinet. The housing has an open lower end 136 to permit extension of the plungers 98 or 122 downwardly to against the various keys of the piano, and the weight of the actuating mechanisms, along with that of the housing, maintains the same on the piano without need for any additional mounting means. The housing is easily placed on and removed from a piano, and may conveniently be stored, such for example as on a fixture added to the rear of any spinet, studio or upright model piano. It should be appreciated, of course, that the assembly is suitable for use with any particular type of piano, inasmuch as all piano keyboards are of a standard length.

The invention thus provides improved electromagnetic piano key actuating mechanisms which are capable of imparting to piano keys forces of sufficient dynamic variation to reproduce an entire piano repertoire exactly as though a pianist had played the same. The devices may readily be installed on a piano either in the factory or in the home of a piano owner, and when installed do not interfere with ordinary or manual playing of the piano. The devices exert exact forces on the piano keys to sound notes with precise volumes from pppp (extremely soft) to ffff (as loud as the piano can produce), with all shades in between, while at the same time are capable of sustaining the duration of notes played without need for separate pedal actions. The devices may be easily installed in any type of piano, and in operation do not produce any extraneous noises.

While embodiments of the invention have been described in detail, it is understood that various modifications and other embodiments thereof may be devised by one skilled in the art without departing from the spirit and scope of the invention, as defined in the appended claims.

What is claimed is:

1. In combination with a piano having a piano key mounted for pivotal movement about a fulcrum, said piano key having a forward end to a forward side of said fulcrum which is depressed or moved downwardly to play a note, a piano key actuating system comprising a first electromagnet having a winding across which an energizing signal may be applied; a second electromagnet having a winding across which an energizing signal may be applied; means for movably mounting said first electromagnet above an upper surface of said forward end of said key for movement toward and away from said upper surface; means extending between said first electromagnet and said upper surface of said key for depressing said forward end of said key upon downward movement of said first electromagnet; means for fixedly mounting said second electromagnet above said first electromagnet, said first and second electromagnets being mounted so that the same present opposed but spaced pole faces to each other; and means for interconnecting said first and second electromagnet windings such that upon application of an energizing signal thereacross like magnetic poles are developed at said opposed pole faces, whereby said first electromagnet is repelled away from said second electromagnet and toward said upper surface of said key to depress said key and strike a note on said piano.

2. The combination as in claim 1, including means for normally urging said first electromagnet upwardly and away from said key, so that in the absence of an energizing signal said forward end of said key is not depressed.

3. The combination as in claim 1, wherein said first and second electromagnet mounting means always maintain a space between said opposed pole faces, whereby said pole faces do not come in contact and no extraneous noises are generated incident to striking a note.

4. The combination as in claim 1, wherein said first electromagnet comprises a plurality of first electromagnets each having a winding, said second electromagnet comprises a plurality of second electromagnets equal in number to said plurality of first electromagnets and each having a winding, said first and second electromagnet mounting means mount the same in associated pairs having opposed magnetic pole faces, and said means for interconnecting said windings interconnects the windings of each said associated pair, such that upon application of an energizing signal across the windings of an associated pair like magnetic poles are developed at the opposed pole faces thereof and the first electromagnet of the pair is repelled away from the second, so that the intensity of note struck may be determined by the number of associated pairs of electromagnets energized and/or by the strengths of the energizing signals applied to the electromagnets.

5. The combination as in claim 1 or 4, wherein said piano has a keyboard with a plurality of piano keys, further including a plurality of said piano key actuating systems associated with separate ones of said keys.

6. The combination as in claim 5, including an elongate housing for containing therewithin said piano key actuating systems, said housing being positionable over and along said piano keyboard with opposite ends of said housing being supported by opposite sides of the piano cabinet, said housing having an opening along its side whereat it faces said keyboard for extension therethrough of said extending means.

7. In combination with a piano having a piano key mounted for pivotal movement about a fulcrum, said piano key having a forward end to a forward side of said fulcrum which is depressed or moved downwardly to play a note, a piano key actuating system comprising a first electromagnet having a winding across which an energizing signal may be applied; a second electromagnet having a winding across which an energizing signal may be applied; means for movably mounting said first electromagnet above an upper surface of said forward end of said key for movement toward and away from said upper surface; means extending between said first electromagnet and said upper surface of said key for depressing said forward end of said key upon downward movement of said first electromagnet; means for fixedly mounting said second electromagnet between said first electromagnet and said upper surface of said key, said first and second electromagnets being mounted so that the same present opposed but spaced pole faces to each other; and means for interconnecting said first and second electromagnet windings such that upon application of an energizing signal thereacross unlike magnetic poles are developed at said opposed pole faces, whereby said first electromagnet is attracted toward said second electromagnet and toward said upper surface of said key to depress said key and strike a note on said piano.

8. The combination as in claim 7, including means for normally urging said first electromagnet upwardly and away from said key, so that in the absence of an energizing signal said forward end of said key is not depressed.

9. The combination as in claim 7, wherein said first and second electromagnet mounting means always maintain a space between said opposed pole faces, whereby said pole faces do not come in contact and no extraneous noises are generated incident to striking a note.

10. The combination as in claim 7, wherein said first electromagnet comprises a plurality of first electromagnets each having a winding, said second electromagnet comprises a plurality of second electromagnets equal in number to said plurality of first electromagnets and each having a winding, said first and second electromagnet mounting means mount the same in associated pairs having opposed magnetic pole faces, and said means for interconnecting said windings interconnects the windings of each said associated pair, such that upon application of an energizing signal across the windings of an associated pair unlike magnetic poles are developed at the opposed pole faces thereof and the first electromagnet of the pair is attracted toward the second, so that the intensity of note struck may be determined by the number of associated pairs of electromagnets energized and/or by the strengths of the energizing signals applied to the electromagnets.

11. The combination as in claim 7 or 10, wherein said piano has a keyboard with a plurality of piano keys, further including a plurality of said piano key actuating systems associated with separate ones of said keys.

12. The combination as in claim 11, including an elongate housing for containing therewithin said piano key actuating systems, said housing being positionable over and along said piano keyboard with opposite ends of said housing being supported by opposite sides of the piano cabinet, said housing having an opening along its side whereat it faces said keyboard for extension therethrough of said extending means.

* * * * *